US005842482A

United States Patent [19]

Potut

[11] Patent Number: 5,842,482

[45] Date of Patent: Dec. 1, 1998

[54] SPRING HINGE FOR HAIRSTYLING DEVICES

[75] Inventor: Christian Potut, Arbent, France

[73] Assignee: C.S.P. Diffusion, société anonyme, Arbent, France

[21] Appl. No.: 988,741

[22] Filed: Dec. 11, 1997

[30] Foreign Application Priority Data

Dec. 16, 1996 [FR] France ..... 96 15815
Jul. 29, 1997 [FR] France ..... 97 09934

[51] Int. Cl.[6] ..... A45D 8/20; A45D 8/00; A41F 1/00

[52] U.S. Cl. ..... 132/277; 132/275; 132/276; 132/278; 24/510; 24/511

[58] Field of Search ..... 132/275, 277, 132/276, 278; 24/510, 511

[56] References Cited

U.S. PATENT DOCUMENTS

| | | | |
|---|---|---|---|
| 2,201,719 | 5/1940 | Eicher | 132/277 |
| 5,494,060 | 2/1996 | Potut | 132/277 |
| 5,549,127 | 8/1996 | Chang | 132/277 |
| 5,642,740 | 7/1997 | Chen | 132/277 |
| 5,735,296 | 4/1998 | Chen | 132/277 |

FOREIGN PATENT DOCUMENTS

| | | |
|---|---|---|
| 0669088 | 8/1995 | European Pat. Off. . |
| 755662 | 11/1933 | France . |
| 770805 | 9/1934 | France . |
| 29600643 | 3/1996 | Germany . |

*Primary Examiner*—John J. Wilson
*Assistant Examiner*—Trang Doan
*Attorney, Agent, or Firm*—William H. Eilberg

[57] ABSTRACT

A hairstyling device includes, according to the invention, two jaws hinged together by hinge means including a hinge pin and a coil spring wound in a spiral around the pin. The spring is contained in an opaque casing attached to the first jaw, and incorporating a slot through which the second end of the spring passes to bear against the second jaw. This facilitates assembly of the hairstyling device, and enhances its esthetic appearance.

8 Claims, 7 Drawing Sheets

SPRING HINGE FOR HAIRSTYLING DEVICES

BACKGROUND OF THE INVENTION

1. Field of the Invention

The present invention concerns hairstyling devices in which a first jaw is hinged to a second jaw by hinge means including a return spring.

2. Description of the Prior Art

Hairstyling devices in the form of clip for use in women's hair are known in themselves. Clips of this kind have been used for many years, and are described in documents FR-A-770 805, FR-A-775 662 and U.S. Pat. No. 2 201 719, for example.

Prior art hairclips generally have a first jaw and a second jaw, hinged together by hinge means allowing them respectively to pivot about a hinge axis between a spread apart position and a close together position. Spring means bias pivoting movement of the first and second jaws towards each other, towards their close together position. The hinge means comprise two first parallel perforated lugs, on the first jaw, spaced apart by a distance for stability, and, two parallel perforated lugs, on the second jaw, spaced apart appropriately in order to engage with respective opposite sides of the first perforated lugs. A connecting spindle oriented along the hinge axis passes through the four perforated lugs to connect the jaws.

In these prior art hairclips, the spring means comprise an elastically flexible metal wire spring wound helically around the hinge axis. A first end of the elastically flexible wire extends radially away from the axis and bears on the inside face of the first jaw. The second end of the elastically flexible wire extends radially away from the axis and bears against the second jaw. The spring is prestressed rotationally about the axis, so that its two projecting ends bias the jaws towards their close together position.

A first disadvantage of this prior art structure is the result of the particular use of the hairstyling devices, whereby their rear part, i.e. the part consisting of the hinge area and the elastically flexible metal wire wound in a helix, can be seen when they are in place in the hair. This produces a particularly unesthetic effect, because the structure of the elastically flexible metal wire spring is clearly visible and gives a hairstyling device that in principle should constitute an ornamental item the appearance of a mechanical device.

Another important disadvantage of this prior art structure is the difficulty of mounting the prestressed spring. The four components, namely the two jaws, the spring and the connecting spindle, have to be assembled at one and the same time, applying to the spring an appropriate force to overcome the prestressing exerted by its radially projecting ends.

A first problem addressed by the present invention is eliminating the visible character of the spiral spring, without ruling out the use of a spring of this kind, which is efficient and of low cost. The intention is therefore to produce a hairstyling device in which the visible face has a satisfactory esthetic appearance, combined with a satisfactory clamping action of the jaws.

The invention is simultaneously directed to facilitating the assembly of the hairstyling device, by facilitating the operation of bringing and assembling together the spring, the connecting spindle and the jaws.

Accordingly, the structure of the hairstyling device in accordance with the invention must be manufacturable at low cost, and must in particular be quick and simple to assemble, whilst having an improved esthetic appearance.

SUMMARY OF THE INVENTION

To achieve the above and other objects, the structure of a hairstyling device in accordance with the invention comprises :

- a first jaw and a second jaw, hinged together by hinge means allowing them to pivot about a hinge axis between a spread apart position and a close together position, with two opening levers extending the respective jaws beyond the hinge axis,
- an elastically flexible wire spring wound in a helix around the hinge axis and having two radially projecting ends respectively adapted to bias the first jaw and the second jaw relative to each other towards one of the spread apart or close together position,
- the hinge means comprising, on the first jaw, two parallel first perforated lugs spaced apart by a distance for stability, and, on the second jaw, two parallel second perforated lugs spaced from each other appropriately to engage with respective opposite sides of the first perforated lugs, with a connecting spindle oriented along the hinge axis and passing through the four perforated lugs to connect the jaws.

Furthermore, according to the invention, on at least a visible rear face between the opening levers, the spring is accommodated behind at least one concealing wall which is fixed to the first jaw, conceals the gap between the first two perforated lugs, and which is shaped to escape from the second jaw upon relative rotation between the spread apart and close together positions.

In a simplified embodiment of the invention, the concealing wall is attached to the first jaw, delimited by the inside face of the first jaw, by the first two perforated lugs and by a free edge engaging between the spring and an inside face of the second jaw in the spread apart position. Accordingly, the spring is no more visible from the outside when the hairstyling device is on the hair.

In another embodiment of the invention, the spring is housed in a casing fitting between the first perforated lugs and held in a fixed position on the first jaw, the first radially extending end of the spring being in fixed bearing engagement with the casing or the first jaw, the second radially projecting end of the spring passing through a passage in the casing to bear functionally against the second jaw and to bias it towards the close together position, the casing having ends incorporating openings to provide a passage for the connecting spindle.

In this way, the spring is concealed by the casing, and can no longer be seen when the hairstyling device is in use. Moreover, the casing is easy to grasp and manipulate, which facilitates positioning during assembly of the component parts of the hairstyling device.

The opening in the casing is preferably an arcuate external peripheral slot allowing angular movement of the second radially projecting end of the spring about the hinge axis.

To facilitate assembly further, the casing can advantageously have ends each having a transverse face in bearing engagement with facing inside faces of the first lugs and associated with a rim on three of its sides, the rim enveloping at least part of the external edges of the first lugs. Accordingly, the casing can be forcibly slid between the first lugs longitudinally, and therefore held in translation and in rotation onto the first jaw ; upon sliding along the first jaw, the second radially projecting end of the spring can come to bear on the second jaw to pivot progressively in the slot in the casing about the rotation axis and prestress the spring. Assembly is then effected by inserting the connecting spindle through the holes in the perforated lugs.

In a first advantageous variant, the casing is obtained by assembling:

a casing body with an axial tubular internal housing shaped to receive and to retain the spring and to prevent rotation of its first radially projecting end accommodated in its bottom, with a plane bearing face bearing against a corresponding face of the first jaw in the position with the casing assembled to the first jaw, and an end hoop attached to the casing body to extend its second end whilst leaving an arcuate external peripheral slot between the casing body and the end hoop to provide a passage for the second radially projecting end of the spring.

In a second advantageous variant, the casing is formed of a casing body with a U-shape cross-section having two parallel longitudinal edges for pressing it against a corresponding face of the first jaw in the position with the casing assembled to the first jaw, with a notch in one of the longitudinal edges to provide a passage for the first radially projecting end of the spring, and with an arcuate external peripheral slot in an exterior wall of the casing body to provide a passage for and to allow angular movement of the second radially projecting end of the spring.

In another simplified embodiment, the attached casing is retained on the first jaw by virtue of clipping onto the spring itself.

Other objects, features and advantages of the present invention will emerge from the following description of specific embodiments of the invention, given with reference to the accompanying drawings.

DETAILED DESCRIPTION OF THE PREFERRED EMBODIMENTS

Figure 1:
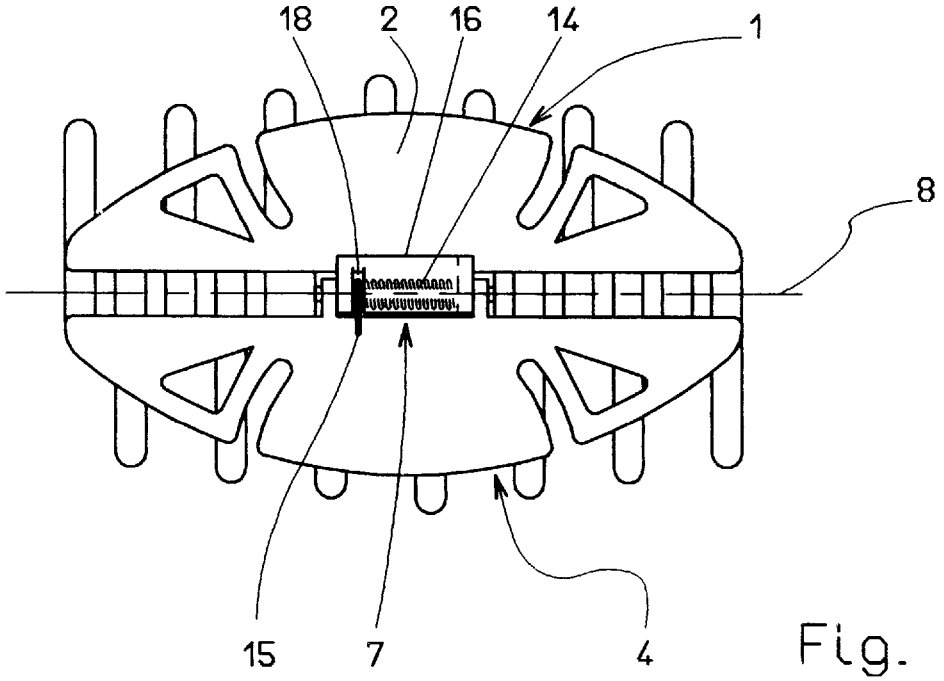
FIG. 1 is a front view of a hairstyling device in the form of a hairclip constituting a first embodiment of the present invention, shown in the closed position.

In the embodiments shown in the figures, a hairstyling device of the invention is a hairclip comprising a first jaw 1 which can be actuated by a first opening lever 2 to which it is fastened in a first intermediate connecting area 3, and a second jaw 4 that can be actuated by a second opening lever 5 to which it is fastened in a second intermediate connecting area 6.

Figure 2:
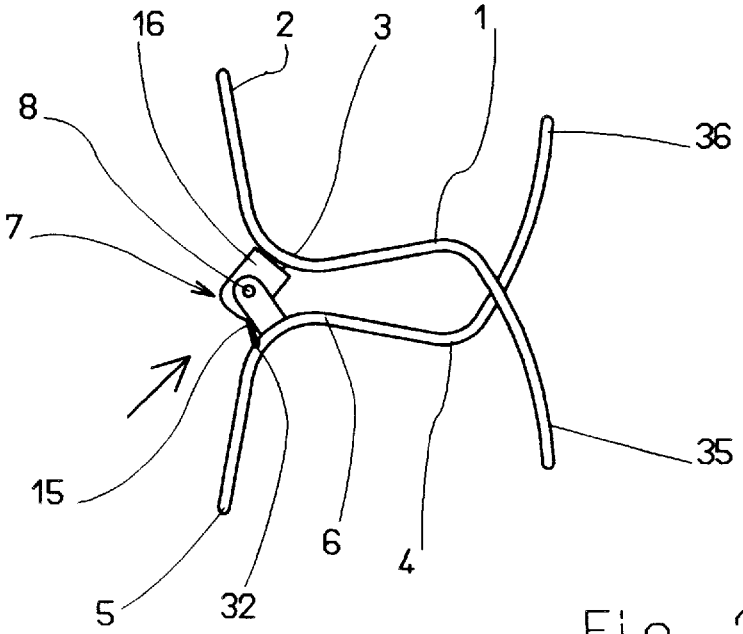
FIG. 2 is a righthand side view of the hairstyling device from FIG. 1 in the closed position.
Figure 3:
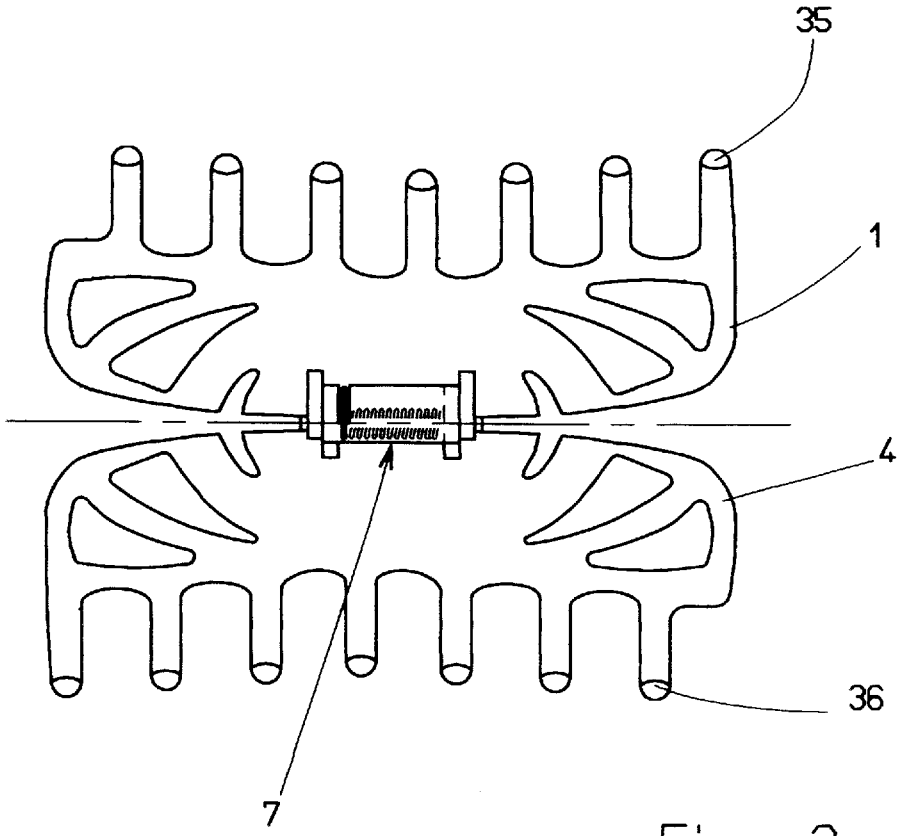
FIG. 3 is a front view of the hairstyling device from FIG. 1 in the open position.
Figure 4:
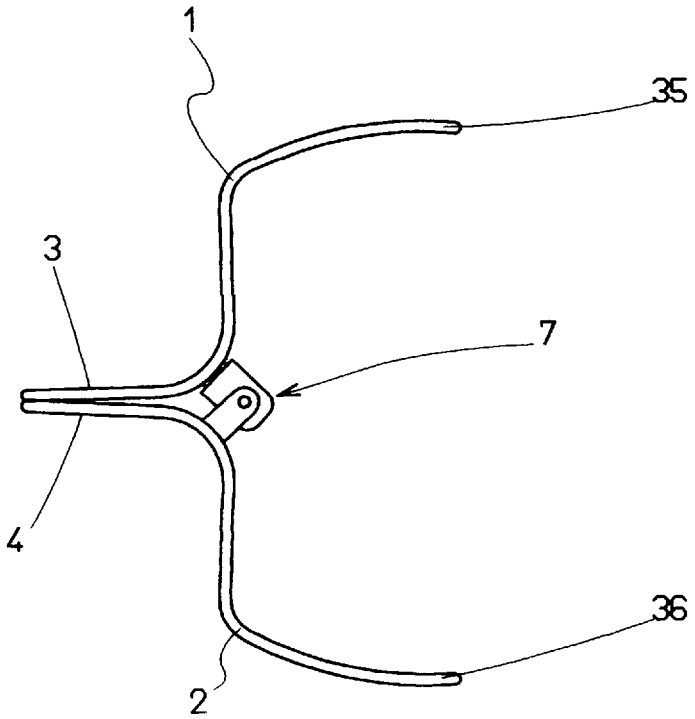
FIG. 4 is a righthand side view of the hairstyling device from FIG. 1 in the open position.

Hinge means 7 connect the first intermediate connecting area 3 and the second intermediate connecting area 6, to allow relative pivoting of the first jaw 1 and the second jaw 4 relative to each other about a transverse hinge axis 8 between a spread apart position shown in FIG. 4 and a close together position shown in FIG. 2. Spring means bias relative pivoting of the first jaw 1 and the second jaw 4 relative to each other towards their close together position.

Figure 11:
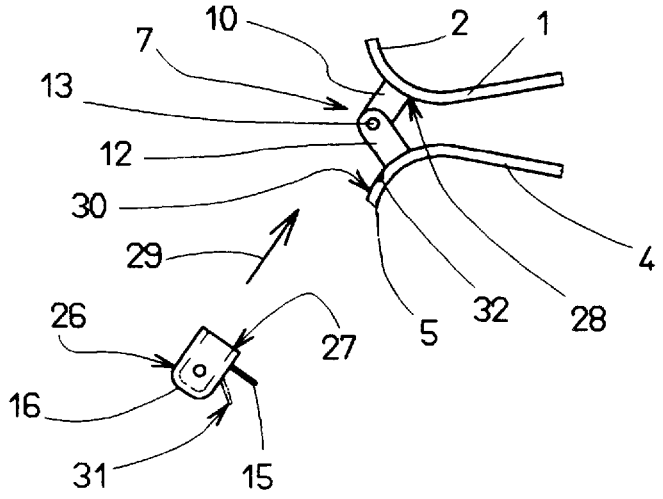
FIG. 11 is a fragmentary side view showing the movement of assembling the casing onto the jaws.
Figure 12:
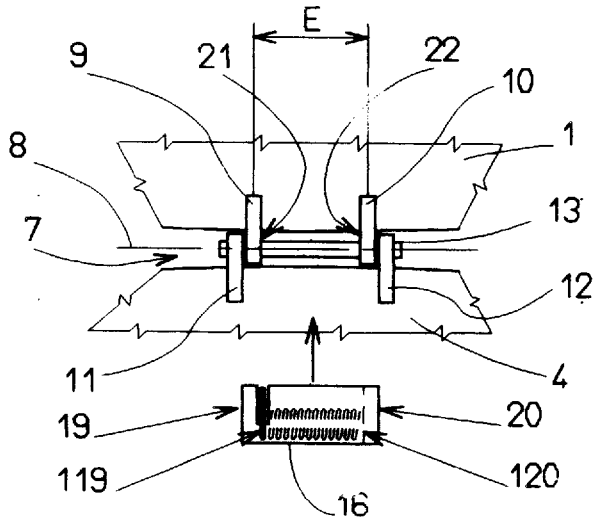
FIG. 12 is a fragmentary front view showing the structure of the perforated lug hinge means and the movement of assembling the casing onto the jaws.
Figure 13:
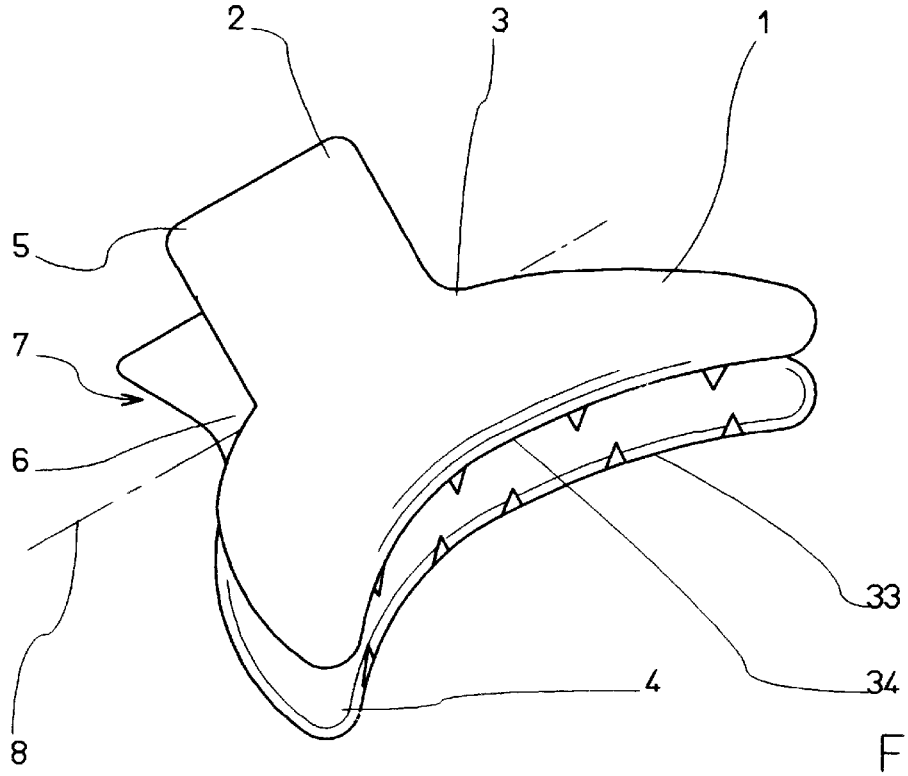
FIG. 13 is a perspective view of a hairstyling device constituting another embodiment of the present invention.
Figure 14:
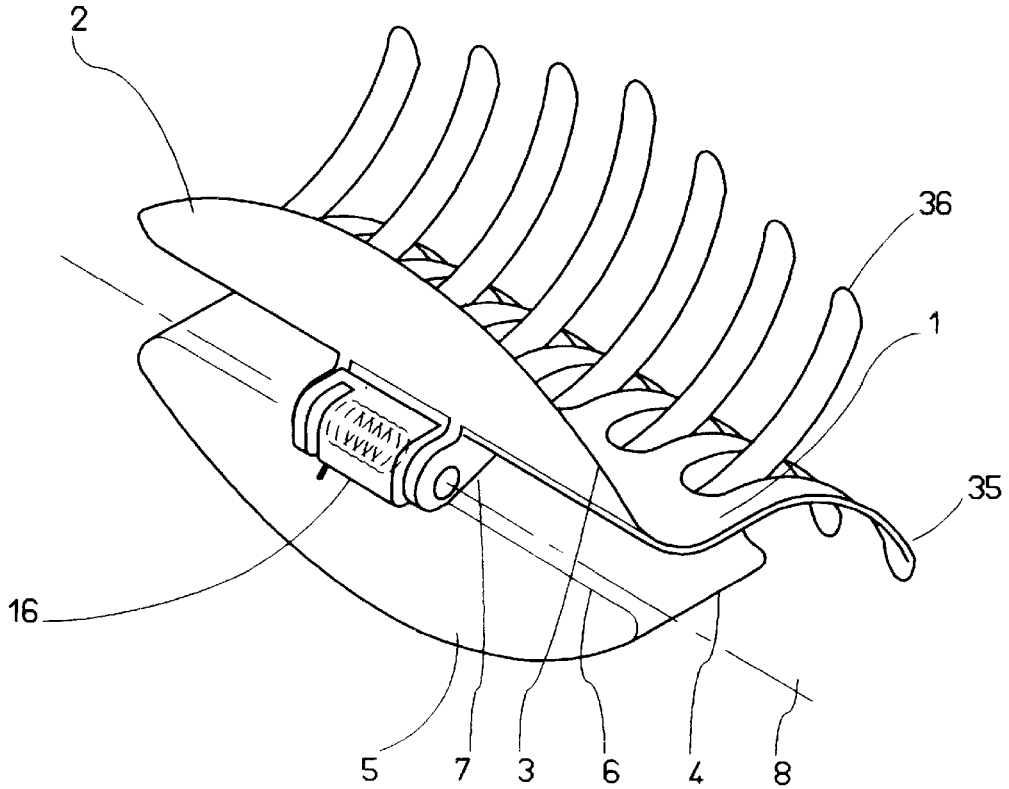
FIG. 14 is a perspective view of a hairstyling device constituting another embodiment of the present invention.

The hinge means used in accordance with the invention can be seen more clearly in FIGS. 11 and 12, in which the spring means are not yet fitted to the jaws 1 and 4. The hinge means 7 comprise two parallel first perforated lugs 9 and 10, on the first jaw 1, spaced apart by a distance E for stability. The hinge means 7 comprise two second parallel perforated lugs 11 and 12, on the second jaw 4, spaced apart by a distance appropriate to engage with respective opposite sides of the first perforated lugs 9 and 10. A connecting spindle 13, oriented along the hinge axis 8, passes through the four perforated lugs to connect the jaws 1 and 4.

As can be seen in FIG. 1, the hinge means 7 further comprise an elastically flexible wire spring 14 wound in a helix around the hinge axis 8 and having two radially projecting ends like the second end 15. The radially projecting ends of the spring 14 bias relative pivoting of the first jaw 1 and the second jaw 4 about the hinge axis 8.

In a first embodiment of the invention, the spring 14 is housed in a casing 16, fitting between the first perforated lugs 9 and 10 and fastened to the first jaw 1.

In a first variant of this first embodiment, shown in FIGS. 5 through 10, the casing 16 has a peripheral wall having a cylindrical external part 26 and a plane bearing face 27 shaped to bear against a corresponding plane face 28 of the first jaw in the position with the casing 16 assembled onto the first jaw 1. The first radially projecting end 17 of the spring 14 is attached to the casing 16, and therefore to the first jaw 1. The second radially projecting end 15 of the spring 14 passes through an opening 18 in the casing 16 to bear functionally against the second jaw 4, as shown in FIGS. 1 and 2.

The opening 18 in the casing 16 is an arcuate exterior peripheral slot, allowing angular movement of the second radially projecting end 15 of the spring 14 about the hinge axis 8.

In the first variant shown in FIGS. 5 through 10, the casing 16 has ends 19 and 20 each having a respective transverse face 119 or 120 shaped to bear against the corresponding inside faces 21 and 22 (FIG. 12) of the first lugs 9 and 10. Each transverse face is associated with a respective rim 23 and 24 on three sides surrounding at least in part the external edges of the first lugs 9 and 10. The lower side of the transverse faces 119 and 120 of the ends 19 and 20, such as the side 25 shown in FIG. 5, has no such rim. Accordingly, as can be seen in FIGS. 11 and 12, the casing 16 can be forcibly slid between the first lugs 9 and 10, the transverse faces 119 and 120 of its ends 19 and 20 sliding on the inside lateral faces 21 and 22 of the first lugs 9 and 10 whilst the rims 23 and 24 sliding on the lateral edges of the first lugs 9 and 10. In the assembled position, shown in FIGS. 1 and 2, the casing 16 is therefore secured to the first jaw 1 in translation and in rotation, and is retained by the spring 14 around the connecting spindle 13.

Figure 5:
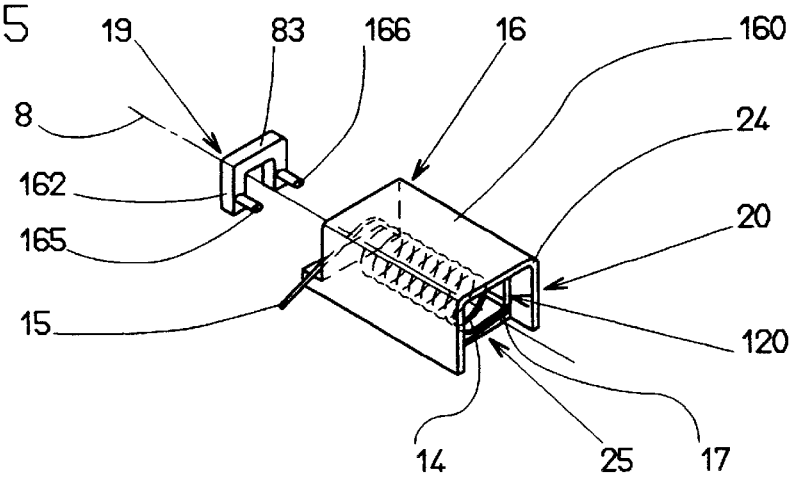
FIG. 5 is an exploded perspective view showing the two component parts of a casing in a first embodiment of the present invention.
Figure 6:
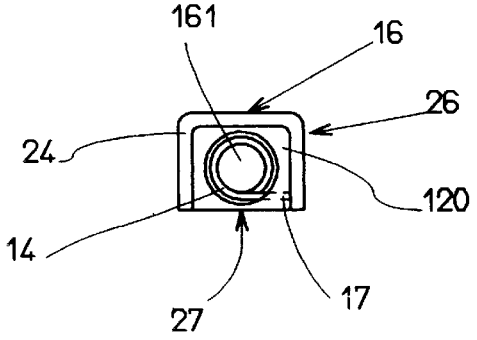
FIG. 6 is a righthand end view of the casing from FIG. 5.
Figure 7:
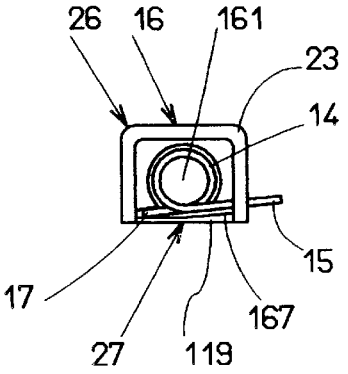
FIG. 7 is a lefthand end view of the casing from FIG. 5.

In the embodiment shown in FIG. 5, the casing 16 is obtained by assembling a casing body 160 with an axial internal housing 161, open at both ends to provide a passage for the connecting spindle 13, and shaped to receive and to retain the spring 14 and to prevent its first radially projecting end 17 housed in its bottom rotating. An end hoop 162 extends the casing body at its second end leaving a passage for the connecting spindle 13 and an arcuate peripheral slot 18 between the casing body 160 and the end hoop 162.

Figure 8:
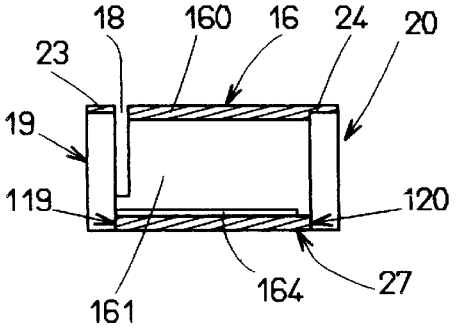
FIG. 8 is a front view in median longitudinal section of the casing from FIG. 5.

As can be seen more clearly in FIG. 8, the casing body 160 incorporates a longitudinal groove 164, allowing engagement of the first end 17 of the spring 14. Accordingly, the spring 14 can be engaged in the axial internal housing 161 by sliding it axially from the second end, after which the hoop 162 can be attached to the casing body 160 to which it is fastened by two studs 165 and 166 engaging in corresponding holes in the casing body 160, for example. The second end of the casing body 160 incorporates an oblique shoulder 167 extending from the bottom and on which the second end 15 of the spring 14 can rest. The shoulder 167 forms the first end of the arcuate slot 18.

Figure 9:
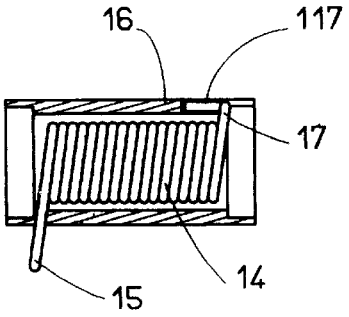
FIG. 9 is a top view in longitudinal section of the casing from FIG. 5.
Figure 10:
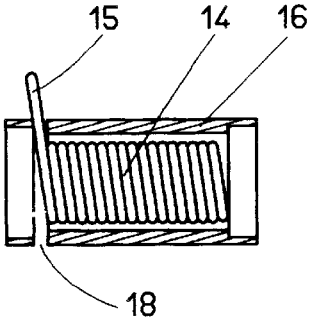
FIG. 10 is a bottom view in longitudinal section of the casing from FIG. 5.

It may be useful to provide a first end 17, on the spring 14, with an axial section, as shown in FIG. 9. The force with which the spring bears on the casing is then distributed over a larger surface area, which reduces wear of the casing and the risk of play appearing.

Figure 15:
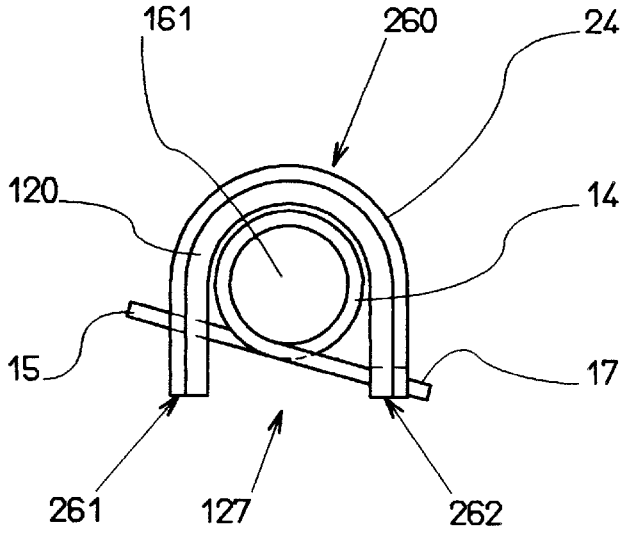
FIG. 15 is an end view of a casing in one embodiment variant of the invention.
Figure 16:
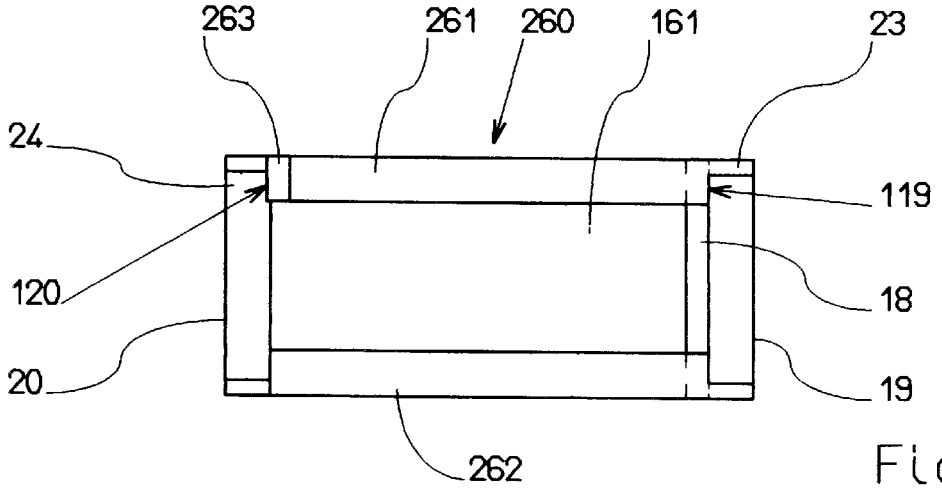
FIG. 16 is a bottom view of the casing from FIG. 15.
Figure 17:
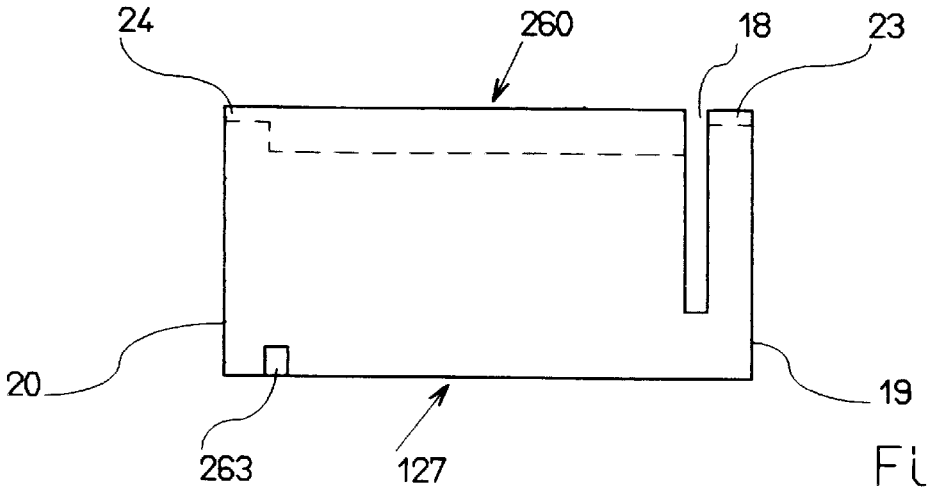
FIG. 17 is a front view of the casing from FIG. 15.

In a second advantageous variant shown in FIGS. 15 through 17, the casing 16 is formed of a U-shape cross-section casing body 260, having two parallel longitudinal edges 261 and 262 separated by a lateral opening 127 and adapted to be pressed against the corresponding face 28 of the first jaw 1 in the position with the casing 16 assembled to the first jaw 1. A notch 263 in the first longitudinal edge 261 provides a passage for the first radially projecting end 17 of the spring 14. The arcuate exterior peripheral slot 18 is in the exterior wall of the casing body 260, to provide a passage for and to allow angular movement of the second radially projecting end 15 of the spring 14. The other casing body parts are identical to those of the first embodiment, namely: the ends 19 and 20 open to provide the passage for the connecting spindle 13; the transverse faces 119 and 120; the rims 23 and 24.

In this second variant, the casing body can be molded in one piece.

Alternatively, it can be obtained by assembling a main part and a hoop similar to the hoop 162 from FIG. 5.

To retain the casing 16 of this second variant on the first jaw 1, means are provided for connecting it mechanically to the spring 14 or to the connecting spindle 13, either by branches at the ends of the U-shape casing body which extend towards each other and bear laterally on respective opposite sides of the spring 14, or by end flanges having a hole through which the connecting spindle 13 passes.

In the embodiment shown in the figures, the lugs 9, 10, 11 and 12 are each in the form of a flat tongue with a rounded end, for example a circular arc shaped end. The casing 16 has a peripheral wall having a cylindrical external part 26 espousing the curvature of the rounded ends of the lugs 9–12.

To fit the casing 16 to the first law 1, the casing 16 is moved in translation in the direction of the arrow 29 shown in FIG. 11, orienting the casing 16 with its plane face 27 or its lateral opening 127 at the front and holding the jaws with the holes in the perforated lugs 9–12 in a line. In this orientation, the casing 16 slides between the first lugs 9 and 10, and the second end 15 of the spring 14 comes to bear on the posterior face 30 of the second opening lever 5. Accordingly, the second end 15 of the spring is pushed back and pivots as shown in FIG. 11 by the dashed lines 31. On completion of engagement of the casing 16 on the first lugs 9 and 10, the second end 15 of the spring 14 engages in a housing 32 on the posterior face 30 of the second opening lever 5, the spring 14 being prestressed.

The casing 16 is preferably made from an opaque material, to conceal the spring 14 that it contains. Accordingly, as shown in FIG. 1, the hinge means 7 have a relatively continuous appearance, which is much more esthetic than an uncovered helical spring.

In the embodiments previously described, the casing 16 both conceals the spring 14 and facilitates assembly of the hairstyling device.

The next two embodiments simplify the structure, concealing the spring 14, but without facilitating fitting of the spring.

Figure 18:
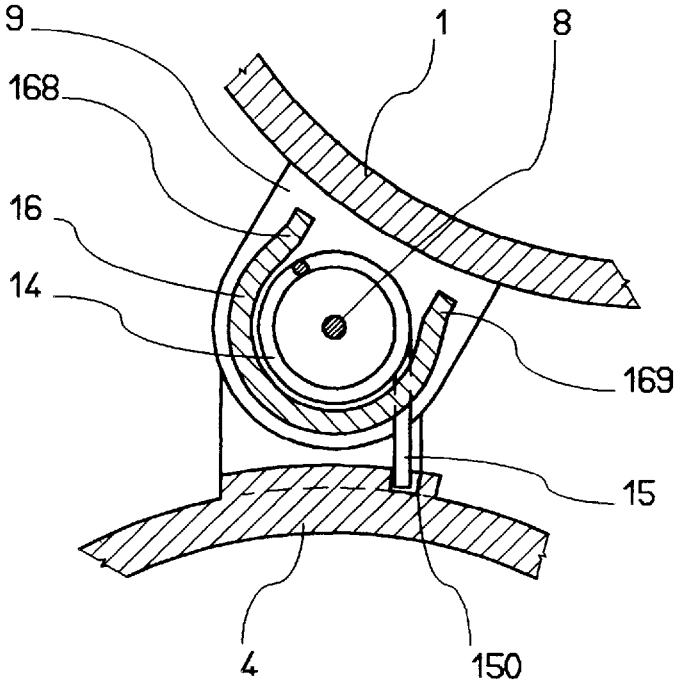
FIG. 18 is a sectional side view of a simplified embodiment of the invention.

In a second embodiment shown in FIG. 18, the attached casing 16 is simply retained on the first jaw 1 by clipping it onto the spring 14. To this end, the casing 16 is in the form of an open channel with a U-shape cross-section the two branches 168 and 169 of which are generally parallel but slightly convergent towards each other and at a distance slightly less than the outside diameter of the spring 14 when they are not stressed. The casing 16 is naturally made from a slightly elastic material, so that it is retained on the spring 14 by the two branches 168 and 169. Rotation preventing means, such as lateral toes or lateral lugs, that are not shown in the figure, prevent the casing 16 from rotating on the first jaw 1, for example by engaging a lug on the casing 16 over the first perforated lug 9.

Figure 19:
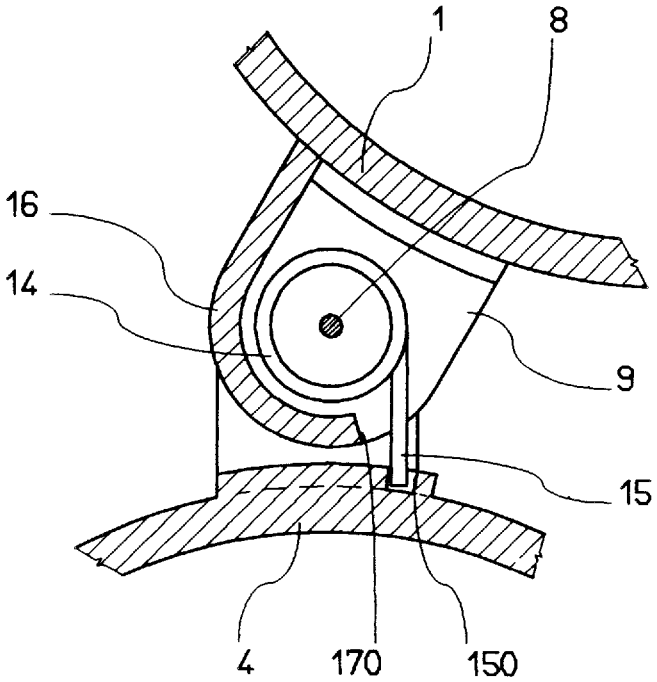
FIG. 19 is a sectional side view of another simplified embodiment of the invention.

In the third embodiment shown in FIG. 19, the casing 16 is a simple rear wall, attached to the first jaw 1, and concealing the gap between the first two perforated lugs 9 and 10, with a free edge 170 engaging between the spring 14 and the inside face of the second jaw 4 in the spread apart position.

It will be understood that, in all the embodiments that have been described, the spring 14 is housed behind at least one concealing wall, at least with regard to its rear face visible between the opening levers 2 and 5 of the hairstyling device. The concealing wall is fixed to the first jaw, and conceals the gap between the first two perforated lugs 9 and 10. The concealing wall is shaped to escape from the second jaw 4 upon relative rotation between the spread apart and close together positions.

In the embodiments of FIGS. 1 through 17, the concealing wall is the posterior wall of a closed or open casing. In the FIG. 18 embodiment, the concealing wall is formed by the rear part of a channel clipped onto the spring 14. In the third embodiment shown in FIG. 19, the rear wall is attached to and in one piece with the first jaw 1.

In all the embodiments, the esthetic effect obtained can be enhanced by additionally concealing the ends 15 and 17 of the spring 14.

In particular, the second end 15 of the spring 14, intended to bear on the second jaw 4, can advantageously be engaged in a housing 150 formed in the inside face of the second jaw 4 in an internal area between the first perforated lugs 9 and 10, as shown in FIGS. 18 and 19. Note the difference compared to the embodiment shown in FIG. 2, for example, in which the second end 15 can be seen from the outside face of the hairstyling device, and bears on the second jaw 4 in an external area of the inside face of the second jaw 4, that is to say beyond the first lugs 9 and 10 on the visible side of the hairware article.

In the embodiments in which the second end 15 of the spring 14 is in an inside area between the first perforated lugs 9 and 10, it is advantageous to prevent the second end 15 of the spring 14 applying excessive forces to the walls of the housing 150. To this end, a spring 14 is preferably used made from elastically flexible metal wire having a diameter greater than or equal to 0.9 mm, and wound helically with at least six turns.

In all cases, the first end 17 of the spring 14 is concealed by the concealing wall. In the embodiment shown in FIG. 13, the jaws 1 and 4 form a generally flat and wide clip, with respective front lips 33 and 34 bearing against each other in the closed position of the clip.

In the embodiments shown in FIGS. 1 through 4 and 14, the jaws 1 and 4 form two series of parallel teeth, respectively 35 and 36, curved towards and interdigitated with each other in the close together position.

The invention applies equally to all other forms of hairstyling devices or hairclips with two hinged jaws.

The present invention is not limited to the embodiments that have been explicitly described, but encompasses variants and generalizations thereof within the scope of the following claims.

There is claimed:

1. A hairstyling device including:

a first jaw and a second jaw, hinged together by hinge means allowing them to pivot about a hinge axis between a spread apart position and a close together position, with two opening levers extending respective jaws beyond said hinge axis, an elastically flexible wire spring wound in a helix around said hinge axis and having two radially projecting ends respectively adapted to bias said first jaw and said second jaw relative to each other towards one of said spread apart or close together positions, said hinge means comprising, on said first jaw, two parallel first perforated lugs spaced apart by a distance for stability, and, on said second jaw, two parallel second perforated lugs spaced from each other appropriately to engage with respective opposite sides of said first perforated lugs, with a connecting spindle oriented along said hinge axis and passing through said four perforated lugs to connect said jaws, wherein, on at least a visible rear face between said opening levers, said spring is accommodated behind at least one concealing wall which is fixed to said first jaw, conceals the gap between said first two perforated lugs, and is shaped to escape from said second jaw upon relative rotation between said spread apart and close together positions, wherein said concealing wall is attached to said first jaw, delimited by an inside face of said first jaw, by said first two perforated lugs and by a free edge engaging between said spring and an inside face of said second jaw in said spread apart position.

2. The hairstyling device claimed in claim 1 wherein said spring is housed in a casing fitting between said first perforated lugs and held in a fixed position on said first jaw, said spring having a first radially extending end and a second radially protecting end, said first radially extending end of said spring being in fixed bearing engagement with said casing or said first jaw, said second radially projecting end of said spring passing through a passage in said casing to bear functionally against said second jaw and to bias it towards said close together position, said casing having ends incorporating openings to provide a passage for said connecting spindle.

3. The hairstyling device claimed in claim 2, wherein said casing is retained on said first jaw by virtue of clipping onto said spring.

4.The hairstyling device claimed in claim 2, wherein said casing has ends each having a transverse face in bearing engagement with facing inside faces of said first lugs and associated with a rim on three of its sides to envelope at least part of the external edges of said first lugs, so that said casing can be forcibly slid between said first lugs and therefore held in translation and in rotation onto said first jaw.

5. The hairstyling device claimed in claim 2, wherein said casing is obtained by assembling:

a casing body with an axial tubular internal housing shaped to receive and to retain said spring and to prevent rotation of its first radially projecting end accommodated in its bottom, with a plane bearing face bearing against a corresponding face of said first jaw in the position with said casing assembled to said first jaw, and an end hoop attached to said casing body to extend its second end whilst leaving an arcuate external peripheral slot between said casing body and said end hoop to provide a passage for said second radially projecting end of said spring.

6. The hairstyling device claimed in claim 2, wherein said casing is formed of a casing body with a U-shape cross-section having two parallel longitudinal edges for pressing it against a corresponding face of said first jaw in the position with said casing assembled to said first jaw, with a notch in one of said longitudinal edges to provide a passage for said first radially projecting end of said spring, and with an arcuate exterior slot in an exterior wall of said casing body to provide a passage for and to allow angular movement of said second radially projecting end of said spring.

7. The hairstyling device claimed in claim 5, wherein:

said lugs are each in the shape of a flat tongue with a rounded end, and said casing has a peripheral wall having a cylindrical external part espousing the curvature of said rounded edges of said lugs.

8. A hairstyling device including:

a first jaw and a second jaw, hinged together by hinge means allowing them to pivot about a hinge axis between a spread apart position and a close together position, with two opening levers extending respective jaws beyond said hinge axis, an elastically flexible wire spring wound in a helix around said hinge axis and having first and second radially projecting ends respectively adapted to bias said first jaw and said second jaw relative to each other towards one of said spread apart or close together positions, said hinge means comprising, on said first jaw, two parallel first perforated lugs spaced apart by a distance for stability, and, on said second jaw, two parallel second perforated lugs spaced from each other appropriately to engage with respective opposite sides of said first perforated lugs, with a connecting spindle oriented along said hinge axis and passing through said four perforated lugs to connect said jaws, wherein, on at least a visible rear face between said opening levers, said spring is accommodated behind at least one concealing wall which is fixed to said first jaw, conceals the gap between said first two perforated lugs, and is shaped to escape from said second jaw upon relative rotation between said spread apart and close together positions, wherein said spring is made from a metal wire having a diameter greater than or equal to 0.9 mm, and wound in at least six turns, wherein said first end of said spring is concealed by said concealing wall, and wherein said second end of said spring is engaged in a housing in an inside face of said second jaw in an internal area between said first perforated lugs.

* * * * *